US005881819A

United States Patent [19]

Walters et al.

[11] Patent Number: 5,881,819

[45] Date of Patent: Mar. 16, 1999

[54] FIRE EXTINGUISHER

[75] Inventors: James Craig Walters; Brent Warren Williams; Robert Allen McKinney, all of Fort Worth; Edmund R. Luther, Irving, all of Tex.

[73] Assignee: Dellawill, Inc., Fort Worth, Tex.

[21] Appl. No.: 856,303

[22] Filed: May 14, 1997

[51] Int. Cl.[6] ..... A62C 13/76

[52] U.S. Cl. ..... 169/26; 169/9

[58] Field of Search ..... 169/26, 9

[56] References Cited

U.S. PATENT DOCUMENTS

| | | | |
|---|---|---|---|
| 1,898,482 | 2/1933 | Doughty | 169/26 |
| 1,909,837 | 5/1933 | Laengel | 169/26 |
| 2,674,324 | 4/1954 | Mascarini | 169/26 |
| 3,024,847 | 3/1962 | Vaughn | 169/9 |
| 3,228,474 | 1/1966 | Huthsing | 169/9 |
| 4,299,289 | 11/1981 | Kato | 169/26 |
| 5,551,517 | 9/1996 | Arsenault et al. . | |

*Primary Examiner*—Gary C. Hoge
*Attorney, Agent, or Firm*—Arthur F. Zobal

[57] ABSTRACT

The fire extinguisher includes a container filled with a fire extinguishing liquid and having a normally closed main outlet and support structure extending through an opening of the container wall. A compressed gas cartridge located in the container is supported by the support structure. The support structure has an opening formed therethrough which leads to the end of the compressed gas cartridge. A plunger, an explosive charge, and a heat sensitive fuse, the latter of which has a portion is exposed to the exterior of the container, are located in the opening of the support structure. In the presence of high temperature, the fuse causes the explosive charge to explode and force the plunger to rupture the cartridge which release the gas into the liquid in the container by way of a normally closed gas outlet formed through the wall of the support structure. This causes the liquid to be forced out of the container by way of the normally closed main outlet. In another embodiment, the fire extinguishing material in the container may be a powder.

9 Claims, 2 Drawing Sheets

FIRE EXTINGUISHER

BACKGROUND OF THE INVENTION

1. Field of the Invention

The invention relates to a fire extinguisher employing a fire extinguishing material and a compressed gas cartridge.

2. Description of the Prior Art

U.S. Pat. Nos. 1,766,912; 1,898,482; 4,299,289; and 5,551,517 disclose different types of fire extinguishers some of which employ a fire extinguishing material and a compressed gas cartridge.

SUMMARY OF THE INVENTION

It is an object of the invention to provide a new and useful fire extinguisher that employs a fire extinguishing material and a compressed gas cartridge.

The fire extinguisher comprises a container filled with a fire extinguishing material and having a normally closed main outlet and support structure extending through an opening of the container wall. A compressed gas cartridge located in the container is supported by the support structure. The support structure has an opening formed therethrough which leads to the end of the compressed gas cartridge and which supports a plunger, an explosive charge and a heat sensitive fuse, the latter of which has a portion exposed to the exterior. In the presence of high temperature, the fuse causes the explosive charge to explode and force the plunger to rupture the cartridge which releases the gas into the fire extinguishing material in the container by way of a normally closed gas outlet formed through the wall of the support structure. This causes the material to be forced out of the container by way of the normally closed main outlet.

In the preferred embodiment, the fire extinguishing material is a liquid.

DESCRIPTION OF THE PREFERRED EMBODIMENT

Figure 1:
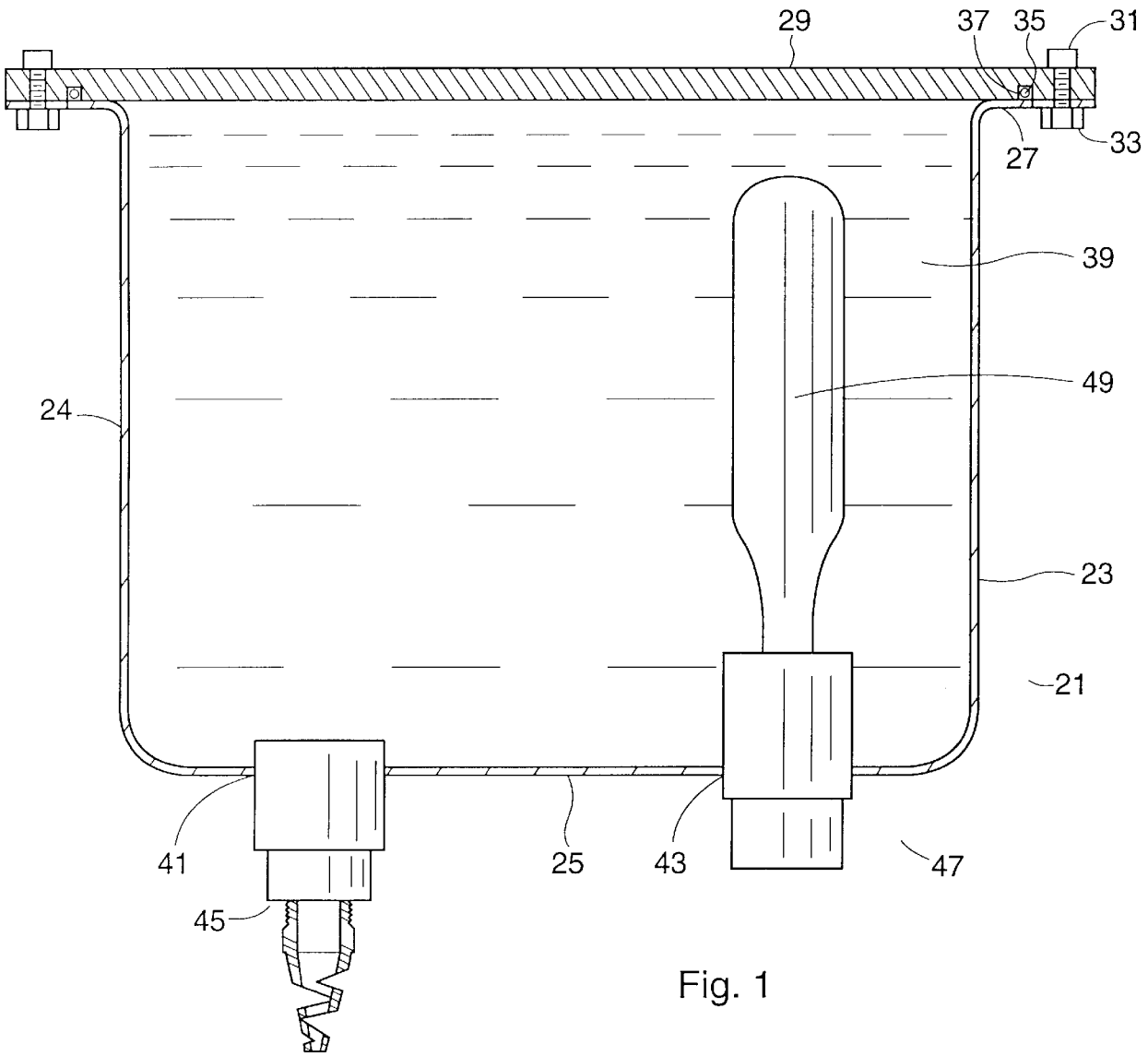
FIG. 1 is a partial cross section of the fire extinguisher of the invention.
Figure 2:
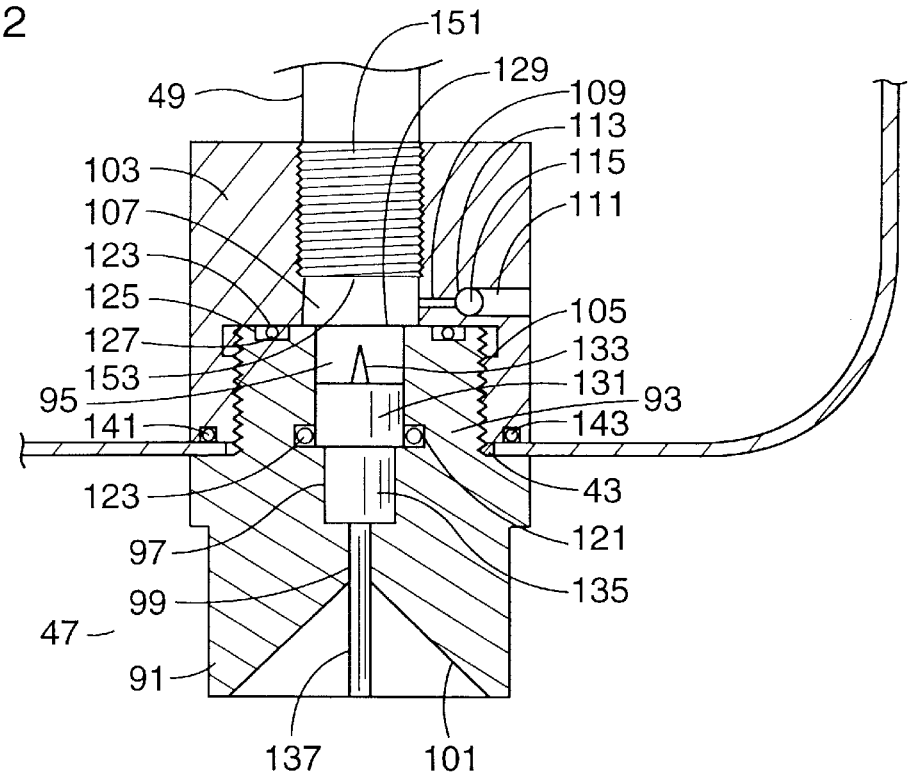
FIG. 2 is an enlarged cross section of the support structure of the fire extinguisher.
Figure 3:
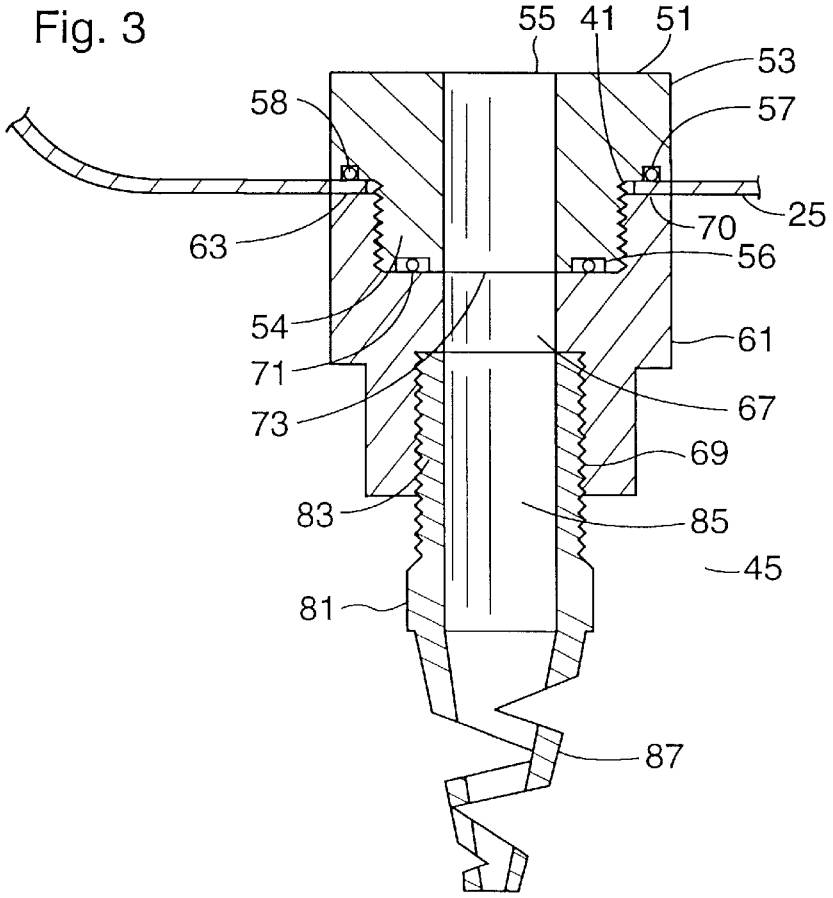
FIG. 3 is an enlarged cross section of the liquid outlet of the fire extinguisher.

Referring now to the drawings, the fire extinguisher is illustrated at 21. It comprises a round stainless steel container 23 having a cylindrical side wall 24, a bottom wall 25 and an upper annular flange 27 having to a round aluminum top or lid 29 secured thereto by bolts 31 and nuts 33. The top 29 may be secured to the flange 27 by rivets. An annular seal 35 is located in an annular slot 37. The container 23 is filled with a fire extinguishing liquid 39.

The bottom 25 has two circular apertures 41 and 43 extending therethrough. Extending through the apertures 41 is the upper portion of a liquid outlet member 45. Extending through the apertures 43 is a support member 47 for supporting a compressed gas container or cartridge 49. The compressed gas located in the cartridge preferably is $CO_2$. The outlet member 45 comprises a metal member 51 having an cylindrical head 53 with a threaded shaft 54 with a central opening 55 extending therethrough. The lower end of the shaft 53 has an annular slot 56 formed therein. An annular slot 57 is formed in the head 53 for receiving an annular seal 58. A metal coupling member 61 has a cylindrical wide upper opening 63 with inner threads, a cylindrical intermediate opening 67 and a cylindrical lower opening 69 with inner threads. The threads of the opening 63 are screwed to the threads of the shaft 54 with the edge of the bottom wall 25 around the aperture 41 located between the head 53 and the annular surface 70 of the member 61 and with an annular seal 71 of a flexible membrane 73 located in the slot 56 such that the membrane 71 stretches across the opening 55, 67. A tubular member 81 has a cylindrical upper end 83 with a cylindrical opening 85 formed therethrough and exterior threads which are screwed to the inner threads of opening 69. The membrane 71 normally closes the opening 55, 67 against the weight of the liquid 49. A spray nozzle 87 is formed at the lower end of the member 81.

The support member 47 comprises a metal member 91 having an upper cylindrical shaft 93 with outer threads and an opening formed therethrough comprising a cylindrical opening 95 which leads to a smaller cylindrical opening 97 which in turn leads to a still smaller cylindrical opening 99 the latter of which leads to cone shaped opening 101. The support member 47 also comprises a member 103 having an opening extending therethrough which comprises a large cylindrical opening 105 with inner threads and a smaller diameter opening 107 with inner threads. The member 103 has an outlet opening formed from the opening 107 to the exterior and comprises a small diameter opening 109 which leads to a larger diameter opening 111 defining a seat 113. A rubber ball 115 is press fitted in the opening 111 against the seat 113. The press fit maintains the ball against the seat 113. The member 103 has an annular slot 141 for receiving a seal 143.

The member 91 has an annular slot 121 for receiving an annular seal 123 and an annular slot 125 for receiving a seal 127 to which a flexible membrane 129 is attached. The membrane 129 extends across the junction of openings 95 and 107.

A metal plunger 131 with a pointed member 133 is located in the opening 95 and explosive charge 135 is located in the opening 95. A heat sensitive fuse 137 is coupled to the charge 135 and extends through opening 99 to the opening 101.

In assembly, before the fire extinguishing liquid is inserted into the container and before the lid 29 is secured in place, a conventional metal $CO_2$ cartridge 49 containing $CO_2$ under pressure has its threaded end 151 screwed to the threads of opening 105 of member 93. The shaft 93 of member 91 is inserted through the container opening 43 with the explosive fuse 137, charge 135, plunger and membrane 129 in place and screwed to the threads of opening 105 of member 103 with the seals 123, 125, and 143 in place and with the ball 115 in place as shown.

The container 23 then is filled with fire extinguishing liquid 39 and the lid 29 secured in place.

In use, the lid 29 may be secured to an object to suspend the fire extinguisher over a structure to be protected such as a stove. If a fire occurs, the fuse 137 will ignite after the temperature reaches a given high level. This actuates the explosive charge 135 which drives the plunger 131 and its pointed member 133 toward the metal end 153 of the cartridge 49. The pointed member 133 pierces the membrane 129 and the cartridge end 153 releasing the high pressure gas from the cartridge. The gas pushes the ball 115 out into the liquid 39 and flows into the liquid by way of the opening 109, 111. The pressurized gas in the liquid, causes the liquid to rupture the membrane 73 such that the fire extinguishing liquid is released for flow through the opening 85 which then sprays downward and outward as it flows through the spray end 87.

The purpose of the membrane 129 is to prevent dust, material, or liquid from entering the opening 107 between the membrane 129 and the cartridge end 153 during the period when the fire extinguisher is in a storage or ready condition awaiting the presence of a fire.

In one embodiment, the fire extinguishing material 39 may be AFFF which is a liquid concentrate added to water, available, commercially from Chemguard in Mansfield, Tex.; the explosive charge 131 may be lead styphnate; the fuse 137 may be a flame activated primer cord fuse; and the cartridge 49 may contain $CO_2$ at a pressure of about 700 psi at room temperature. The outer diameter of the container may be 10 ¾ inches and its height may be 10 inches. The membranes 73 and 129 may be formed of a commercially available latex material, rubber or an elastomer.

In another embodiment, instead of a liquid, the fire extinguishing material in the container 23 may be bicarbonate powder which is forced out of the outlet 45 by the $CO_2$ when released from the cartridge 49 by the plunger when the explosive charge 31 is actuated. The powder acts substantially in the same manner as the liquid for fire extinguishing purposes.

We claim:

1. A fire extinguisher, comprising:

a container having a surrounding wall defining an interior space containing a fire extinguishing material, a main outlet extending through said wall and including closure means for normally closing said main outlet, a cartridge containing a gas under pressure located in said container, said cartridge having an outlet end, an opening extending through said wall of said container, support structure having first and second opposite ends with an opening extending between said opposite ends, said support structure extending through said opening of said container with said first end coupled to said outlet end of said cartridge, a normally closed gas outlet extending through the wall of said support structure from said opening of said support structure and leading to the interior of said container, a plunger located in said opening of said support structure, an explosive charge located in said opening of said support structure between said plunger and said second end, and a heat sensitive fuse located in said opening of said support structure and having a portion exposed to the exterior of said container for causing said explosive charge to explode in the presence of a given high temperature in order to force said plunger toward and against said outlet end of said cartridge and rupture said outlet end to release the gas in said cartridge for flow into said fire extinguishing material in said container by way of said normally closed gas outlet to force said fire extinguishing material out of said container by way of said main outlet.

2. The fire extinguishing of claim 1, wherein:

said fire extinguishing material comprises a liquid.

3. The fire extinguishing material of claim 1, wherein:

said fire extinguishing material comprises a powder.

4. The fire extinguisher of claim 1, comprising:

a flexible membrane located across said opening of said support structure between said outlet end of said cartridge and said plunger, said flexible membrane being penetrable by said plunger when forced toward said outlet end of said cartridge.

5. The fire extinguisher of claim 1, wherein:

said normally closed gas outlet of said support structure comprises a gas opening having a seat facing the interior of said container with a ball normally located in said gas opening for normally closing said gas opening, said gas in said cartridge being under sufficient pressure such that when said gas is released, it can move said ball from said seat out of said gas outlet for flow of said gas into said fire extinguishing material.

6. The fire extinguisher of claim 4, wherein:

said normally closed gas outlet of said support structure comprises a gas opening having a seat facing the interior of said container with a ball normally located in said gas opening for normally closing said gas opening, said gas in said cartridge being under sufficient pressure such that when said gas is released, it can move said ball from said seat out of said gas outlet for flow of said gas into said fire extinguishing material.

7. The fire extinguisher of claim 6, wherein:

said means for normally closing said main outlet comprises a flexible membrane.

8. The fire extinguisher of claim 7, wherein:

said fire extinguishing material comprises a liquid.

9. The fire extinguisher of claim 7, wherein:

said fire extinguishing material comprises a powder.

* * * * *